US006000326A

United States Patent [19]

Nishida

[11] Patent Number: 6,000,326

[45] Date of Patent: Dec. 14, 1999

[54] TRANSFER PRESS HAVING A CROWN AND A BED DIVIDED INTO PLURAL SECTIONS

[75] Inventor: Kenji Nishida, Komatsu, Japan

[73] Assignee: Komatsu Ltd., Tokyo, Japan

[21] Appl. No.: 09/101,094

[22] PCT Filed: Feb. 7, 1997

[86] PCT No.: PCT/JP97/00332

§ 371 Date: Jul. 1, 1998

§ 102(e) Date: Jul. 1, 1998

[87] PCT Pub. No.: WO97/28958

PCT Pub. Date: Aug. 14, 1997

[30] Foreign Application Priority Data

Feb. 8, 1996 [JP] Japan ..... 8-022413
Jul. 4, 1996 [JP] Japan ..... 8-174626

[51] Int. Cl.[6] ..... B30B 1/00

[52] U.S. Cl. ..... 100/193; 72/405.01; 72/455; 100/214

[58] Field of Search ..... 100/193, 207, 100/214; 72/405.01, 455

[56] References Cited

U.S. PATENT DOCUMENTS 3,724,364 4/1973 Munch et al. ..... 100/214
3,779,155 12/1973 Ohno ..... 100/207
5,375,513 12/1994 Michael et al. ..... 100/207

FOREIGN PATENT DOCUMENTS 3322377 1/1985 Germany ..... 100/193
4232604 3/1994 Germany ..... 100/214
56-136300 10/1981 Japan ..... 100/193
57-82499 5/1982 Japan .
2-247031 10/1990 Japan .
5-177399 7/1993 Japan .
8-52597 2/1996 Japan .
1479328 5/1989 U.S.S.R. ..... 100/193

*Primary Examiner*—Stephen F. Gerrity
*Attorney, Agent, or Firm*—Wenderoth, Lind & Ponack, L.L.P.

[57] ABSTRACT

In a transfer press in which a crown (3) is mounted on a plurality of uprights (6) disposed vertically on a bed (4), the crown and the bed are fastened by tie rods (7) penetrating through the respective uprights to thereby constitute a press body (1). A plurality of working stations are set in the press body, the crown and the bed are divided into a plurality of crown sections and bed sections at portions offset from central axes of the tie rods, and the crown sections and the bed sections are respectively fastened by horizontal connection devices (9).

3 Claims, 6 Drawing Sheets

TRANSFER PRESS HAVING A CROWN AND A BED DIVIDED INTO PLURAL SECTIONS

FIELD OF THE INVENTION

The present invention relates to a module-type transfer press in which a crown and a bed of a press body are divided into a plurality of sections and slides are provided for respective crown and bed sections, these parts being constituted as a unit.

BACKGROUND ART

A conventional transfer press has a press body in which a plurality of work stations are formed, and a workpiece is continuously fed from an upstream side of the work stations to a downstream side thereof. However, in a large-sized transfer press of such a structure, the transfer press has a long overall length, and it was difficult to convey the transfer press from a press manufacturing factory to a press setting place.

For this reason, in order to solve such a problem, Japanese Patent Laid-open Publication No. HEI 2-247031 provides a transfer press having a large body which is capable of being easily conveyed with the crown sections and bed sections divided at during manufacturing, and then assembled them into a crown and a bed at the press setting place.

However, the transfer press disclosed in this publication has a structure that two tie rods penetrate through an upright disposed between adjacent places at which two continuous manufacturing steps are performed and the crown and the bed are firmly coupled together. According to such a structure, it is necessary to make large a width of the upright in the bilateral direction (work conveying direction), which results in an elongation of a distance between the respective work stations, and hence, the press body is made large, thus being inconvenient. Furthermore, the weight of the upright is also increased as the width thereof is made large, thus also being inconvenient.

Furthermore, in the case of the upright having an increased width, the penetration holes through which the tie rods penetrate must be formed, respectively, in the uprights, requiring considerable work, thus being inconvenient.

In order to solve such inconveniences, Japanese Patent Laid-open Publication No. HEI 8-52597 provides a transfer press such as shown in FIG. 1.

The transfer press shown in FIG. 1 has a structure such that a crown a and a bed b are divided into a plurality of crown sections and bed sections and a plurality of uprights c are disposed between the respective crown and bed sections a and b. The crown section a and the bed section b are firmly fastened by one tie rod d inserted into each upright c. Key grooves e are formed in upper surfaces of the adjacent crown sections a, tie plates g are fitted to keys f engaged with the key grooves e, and the tie plates g are fastened by nuts h screwed onto upper ends of the tie rods d, respectively, thus positioning the respective crown sections a.

According to the transfer press of the structure mentioned above, however, since the divided surfaces i of the crown sections a and the central axis of the tie rod d are coincident with each other, in a case where the upper surfaces of the adjacent crown sections a have differences due to, for example, manufacturing errors at the time of manufacturing the crown a, the bed b and the upright c, a fastening force applied at the tie rod fastening step is not uniformly applied to the adjacent crown sections a, so that the fastening is not reliably performed. Moreover, at such a time, there will cause such a case that an unbalanced load is applied to the tie plate g and the key f, so that these members may be damaged or positioning performance may be made worse, thus also being inconvenient.

Furthermore, since the respective crown sections a are large in size and large in weight, many steps are required for forming the key grooves e in the upper surfaces of the crown sections a with high performance, thus being inconvenient. The use of the tie plates g and the keys f increases numbers of parts or members to be used, resulting in increased manufacturing cost.

The present invention was conceived to improve the inconveniences encountered in the prior art mentioned above and to provide a transfer press having a structure such that a crown and a bed are divided into a plurality of sections, which are then coupled together by means of horizontal coupling means, so as to reduce the number of parts or members to be used and to reduce the manufacturing cost.

DISCLOSURE OF THE INVENTION

The first mode of the present invention for achieving the above object is characterized by a transfer press in which a crown is mounted on a plurality of uprights disposed vertically on a bed, the crown and the bed are fastened by tie rods penetrating through the respective uprights to thereby constitute a press body, and a plurality of working stations are set in the press body. The crown and the bed are divided into a plurality of crown sections and bed sections at portions offset from central axes of the tie rods. The crown sections and the bed sections are respectively fastened by horizontal connection means.

According to the structure mentioned above, since the press body manufactured at a factory can be conveyed with the crown and the bed being divided into a plurality of sections, the press body can be easily transported.

Furthermore, since the crown and the bed are divided at portions offset from the central axes of the tie rods, no stepped portion is formed at the fastening surfaces of the tie rods during assembly even if manufacturing errors are caused to the crown, the bed and the uprights. Accordingly, the crown and the bed can be accurately fastened. Moreover, since it is not necessary to locate any positioning means such as a tie plate or a key, it is possible to reduce the number of parts or members to be used and hence reduce the manufacturing cost.

The second mode of the present invention for achieving the above object is characterized by a transfer press in which a crown is mounted on a plurality of uprights disposed vertically on a bed, the crown and the bed are fastened by tie rods penetrating through the respective uprights to thereby constitute a press body and a plurality of working stations are set in the press body. Once of the crown and the bed is divided at portions offset from central axes of the tie rods and the other of the crown and the bed is divided at portions near central axes of the tie rods, and the crown sections and the bed sections are respectively fastened by horizontal connection means.

According to the structure mentioned above, since the press body manufactured at a factory can be conveyed with the crown and the bed being divided into a plurality of sections, the press body can be easily transported.

Furthermore, since the crown or the bed is divided at portions offset from the central axes of the tie rods, no stepped portion is formed at the fastening surfaces of the tie rods during assembly even if manufacturing errors are caused to the crown, the bed and the uprights. Accordingly, the crown and the bed can be accurately fastened. Moreover, it is not necessary to locate any positioning means such as a tie plate or key, since it is possible to reduce the number of parts or members to be used and hence reduce the manufacturing cost.

The third mode of the present invention for achieving the above object is characterized by a transfer press in which a crown is mounted on a plurality of uprights disposed vertically on a bed, the crown and the bed are fastened by tie rods penetrating through the respective uprights to thereby constitute a press body and a plurality of working stations are set in the press body. The crown and the bed are divided at portions near central axes of the tie rods, and the crown sections and the bed sections are respectively fastened by horizontal connection means.

According to the structure mentioned above, since the press body manufactured at a factory can be conveyed with the crown and the bed being divided into a plurality of sections, the press body can be easily transported.

Furthermore, since the crown and the bed are divided at portions near the central axes of the tie rods, even if stepped portions are formed at the upper surface of the adjacent crown section and the bottom surface of the adjacent bed section by errors in manufacturing the crown, the bed and the uprights, such stepped portion can be eliminated by grinding the fastening portions or near the upper surface of the crown section and the bottom surface of the bed section by means of a grinder or by interposing shims. Accordingly, in the case of fastening them by the tie rods, the fastening force can be uniformly applied to the adjacent crown sections and bed sections, thus accurately fastening the crown and the bed. Moreover, since it is not necessary to locate any positioning means such as a tie plate or a key, it is possible to reduce the number of parts or members to be used and hence reduce the manufacturing cost.

BRIEF DESCRIPTION OF THE DRAWINGS

The present invention will be made more understandable by way of the following detailed description and accompanying drawings showing exemplary embodiments of the present invention. Further, the embodiments shown in the accompanying drawings do not specify the invention and are for the explanation of the invention and easy understanding thereof.

In the accompanying drawings.

PREFERRED EMBODIMENTS OF THE INVENTION

Transfer presses of preferred embodiments of the present invention will be described hereunder with reference to the accompanying drawings.

The first embodiment of the present invention will be described in detail with reference to FIGS. 2 and 3.

Figure 1:
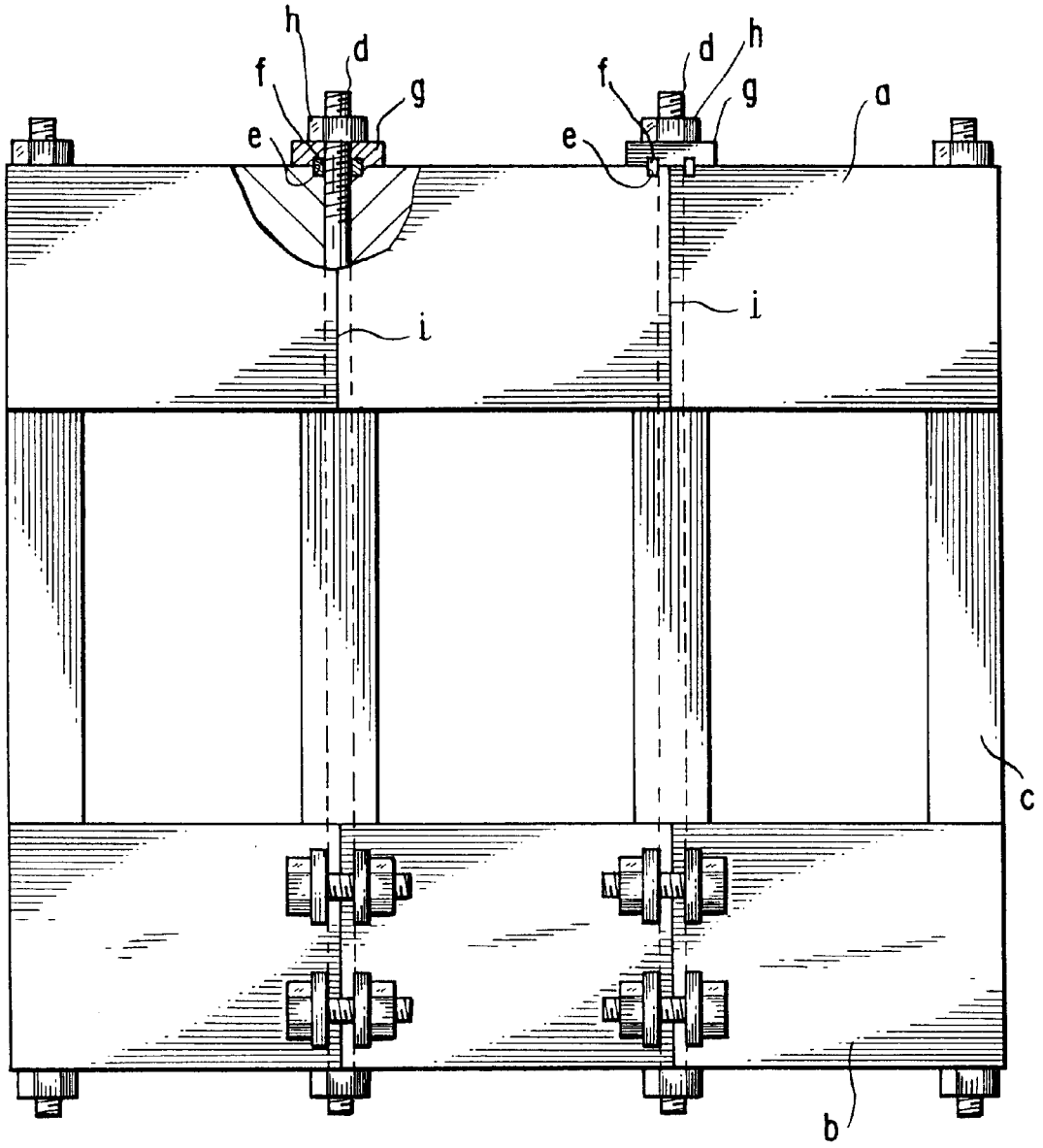
FIG. 1 (PRIOR ART)
FIG. 1 is an explanatory view showing a transfer press having a conventional structure.
Figure 2:
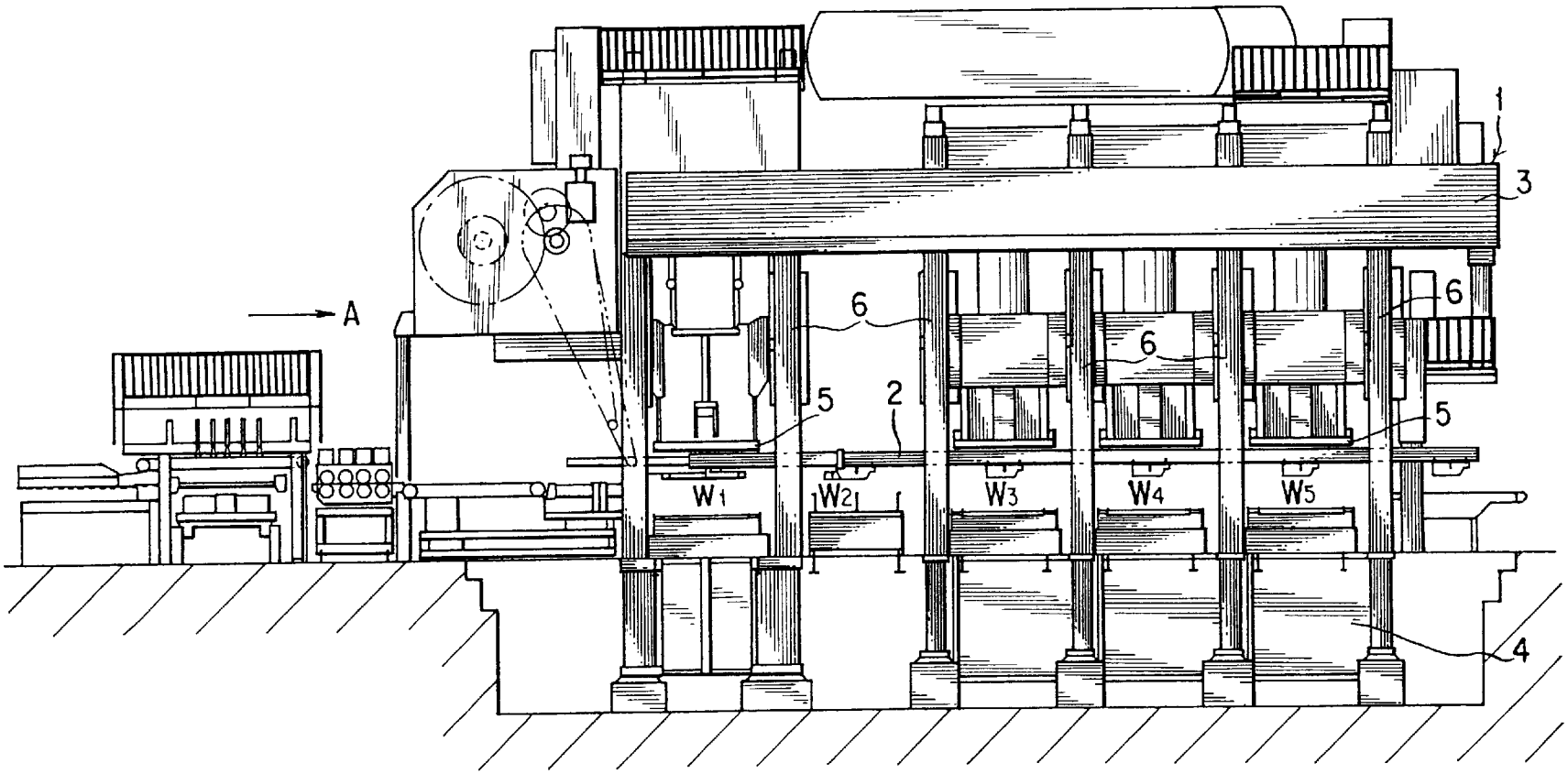
FIG. 2 is a front view of a first embodiment of a transfer press according to the present invention.
Figure 3:
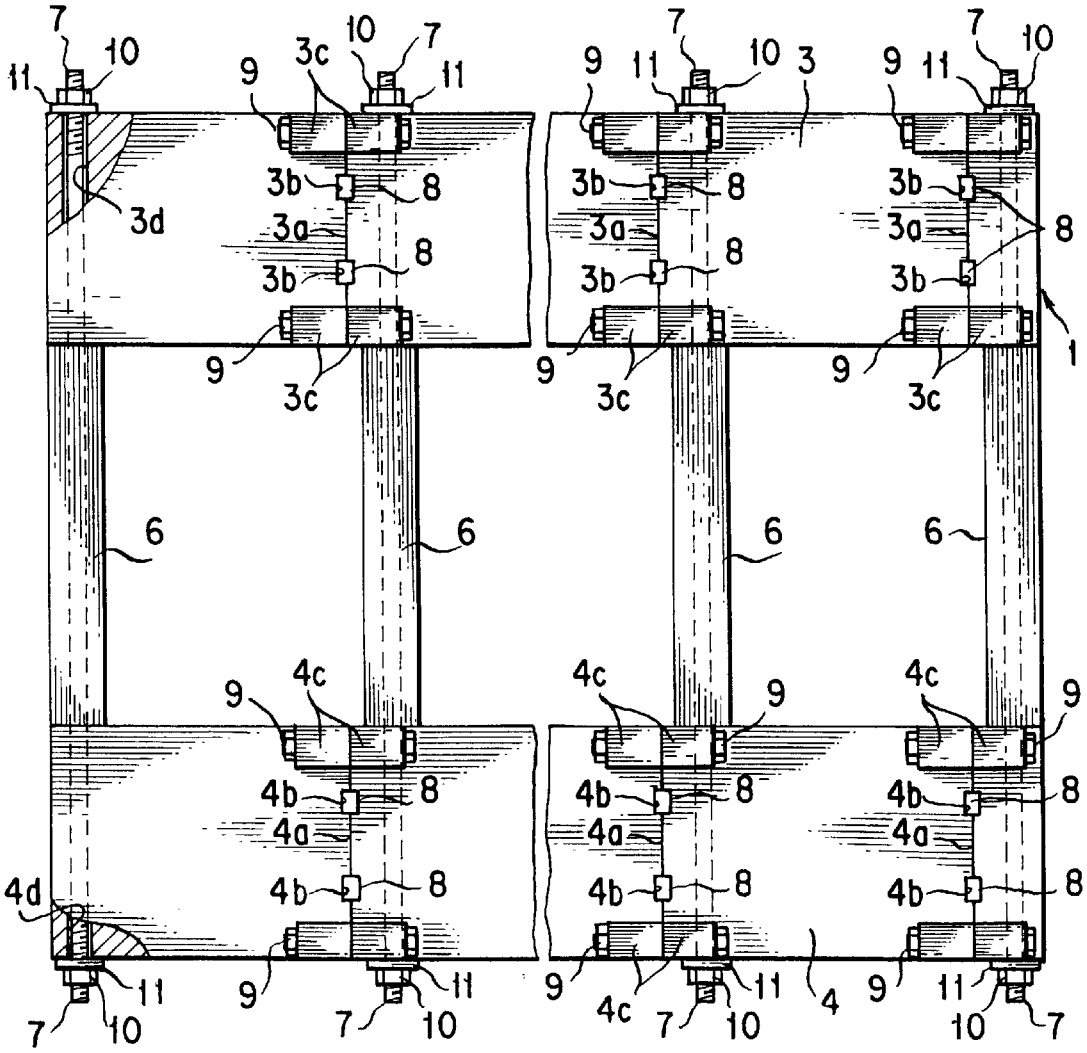
FIG. 3 is a structural view showing an assembling state of a crown and a bed of the first embodiment mentioned above.

FIG. 2 is a front view of a module-type transfer press of the first embodiment of the present invention and FIG. 3 is a view showing the assembling state of divided crown sections and bed sections according to the first embodiment.

The transfer press shown in FIG. 2 has a press body 1 in which a plurality of work stations W1, W2, - - - are formed and a workpiece, not shown, conveyed into the press body 1 from an upstream side thereof (left side as viewed in FIG. 2) is fed sequentially to the respective work stations W1, W2, - - - by means of a transfer feeder 2 at which the workpiece is processed in order, and the processed workpiece is conveyed out of the press body 1 (right side as viewed).

A crown 3 constituting an upper portion of the press body 1 and a bed 4 constituting a lower portion thereof are divided into a plurality of sections for respective work stations W1, W2, - - - , for example, and slides 5 are provided for the respective crown sections 3 so that each crown section 3, each bed section 4 and each slide 5 constitute one assembly of a module-type unit. Furthermore, a plurality of uprights 6 are arranged at intervals in a work feed direction A, as shown in FIG. 3, and separated in a front and rear direction thereof.

The crown sections 3 and the bed sections 4 are coupled and fastened together by means of tie rods 7 each penetrating through each upright 6. According to such a structure, the crown 3 and the bed 4 are divided at portions offset from the central axes of the tie rods 7 so that positioning means such as a tie plate and a key are not required.

FIG. 3 shows a state in which the crown 3 and the bed 4 are divided at positions offset on the upstream side of the center of the tie rod 7. A plurality of key grooves 3*b* and 4*b* are formed respectively in the divided surfaces 3*a* and 4*a* of the crown sections 3 and the bed sections 4 so as to extend in the horizontal direction with spaces therebetween in the vertical direction, and the adjacent crown sections and bed sections are positioned by means of keys 8 engaged with these key grooves 3*b* and 4*b*.

A pair of or a plurality of connection brackets 3*c* and 4*c* are provided to front and rear surfaces of the crown sections 3 and the bed sections 4, respectively, in a manner such that the connection brackets 3*c* and 4*c* are opposed, with the divided surfaces 3*a* and 3*b* being interposed therebetween.

The respective crown sections 3 and the bed sections 4 are coupled together into one assembly by means of horizontal connection means 9 such as tie bolts penetrating through the connection brackets 3*c* and 4*c*.

Further, tie rod penetration holes 3*d* are bored into the upstream and downstream end portions of the crown sections 3 at portions offset downstream from the divided surfaces 3*a* thereof so as to extend in the vertical direction as viewed. The upper end of one tie rod 7 fitted into the upright 6 penetrates through the tie rod penetration hole 3*d* and the penetrating upper end portion has a nut 10 screwed thereonto through a plate 11.

On the other hand, tie rod penetration holes 4*d* are also bored into the divided bed sections 4 respectively concentrically with the tie rod penetration holes 3*d* of the crown sections 3. The lower end of one tie rod 7 penetrates through each of the tie rod penetration holes 4*d* and the penetrating lower end of the tie rod has a nut 10 screwed thereonto through a plate 11. According to the manner mentioned above, the crown sections 3 and the bed sections 4 are fastened by means of tie rods 7, respectively.

The operation of the transfer press of the structure mentioned above will be described hereunder.

The crown sections 3, the bed sections 4, the slides 5 and the uprights 6 are manufactured respectively for each of the modules so as to constitute the press body 1, and the respective members are temporarily assembled in the manufacturing factory and then disassembled, and thereafter, conveyed to a setting place. However, according to the present invention, since the elongated crown 3 and the elongated bed 4 are divided for each of the working stations W1, W2, - - - , these members can be easily transported.

In the process for assembling these members at the setting place, the divided bed sections 4 are fastened integrally by fastening the horizontal connection means 9, with the divided bed sections 4 being positioned relative to one another by the keys 8 provided at the divided surfaces 4*a*.

Then, the uprights 6 are assembled to the bed sections 4, respectively, and the crown sections 3 are then assembled on the respective uprights 6. The divided crown sections 3 are also fastened integrally by fastening the horizontal connection means 9, with the divided crown sections 3 being positioned relative to one another by the keys 8 provided at the divided surfaces 3*a*.

In the state mentioned above, the upper end portion of each of the tie rods 7 penetrating through each of the uprights 6 penetrates through the tie rod penetration hole 3*d* of the crown section 3 and the lower end portion of the tie rod 7 penetrates through the tie rod penetration hole 4*d* of the bed section. Thereafter, the nuts 10 screwed to the upper and lower ends of the tie rods 7 are fastened through the plates 11, respectively, thus fastening the crown sections (crown) and the bed sections (bed).

Further, although the slides 5 are assembled after the assembling of the press body 1, the explanation thereof is omitted herein.

Figure 4:
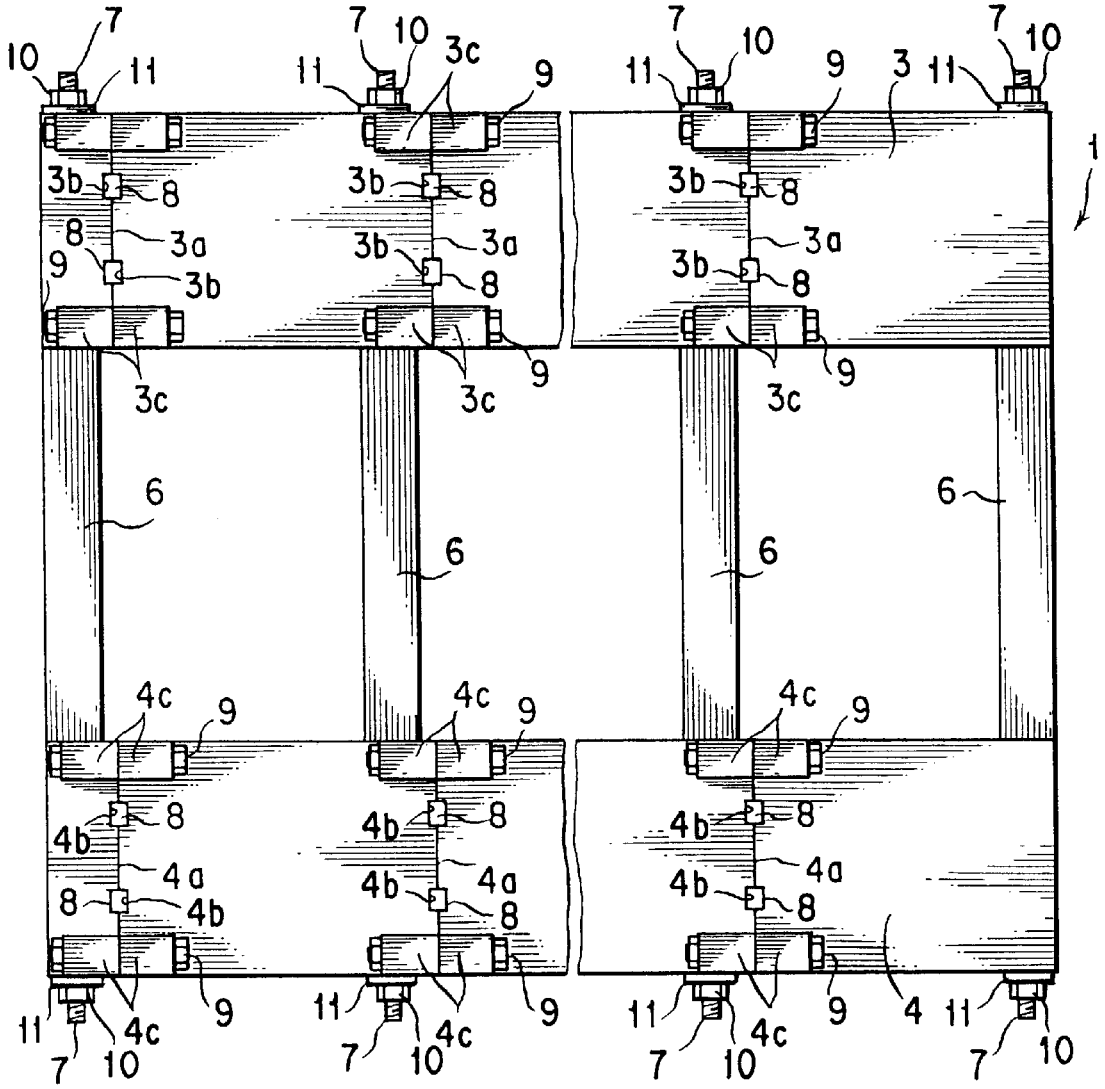
FIG. 4 is a structural view showing an assembling state of a crown and a bed of a second embodiment of the present invention.

FIG. 4 represents a second embodiment in which the crown 3 and the bed 4 are divided by divided surfaces 3*a* and 4*a* positioned downstream of the central axes of the tie rods 7. However, this embodiment performs substantially the same functions as the first embodiment as shown in FIG. 3.

Figure 5:
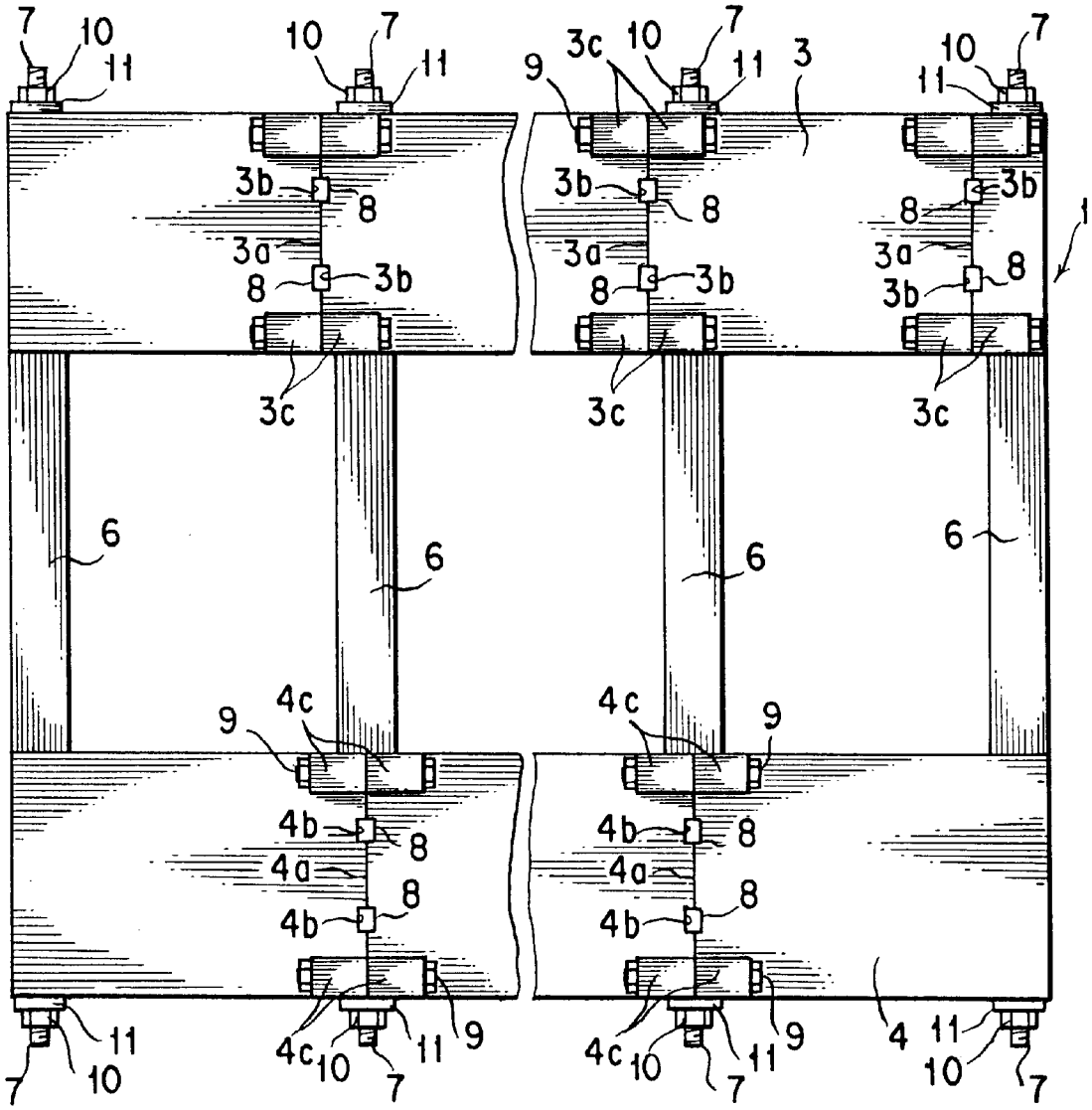
FIG. 5 is a structural view showing an assembling state of a crown and a bed of a third embodiment of the present invention.
Figure 6:
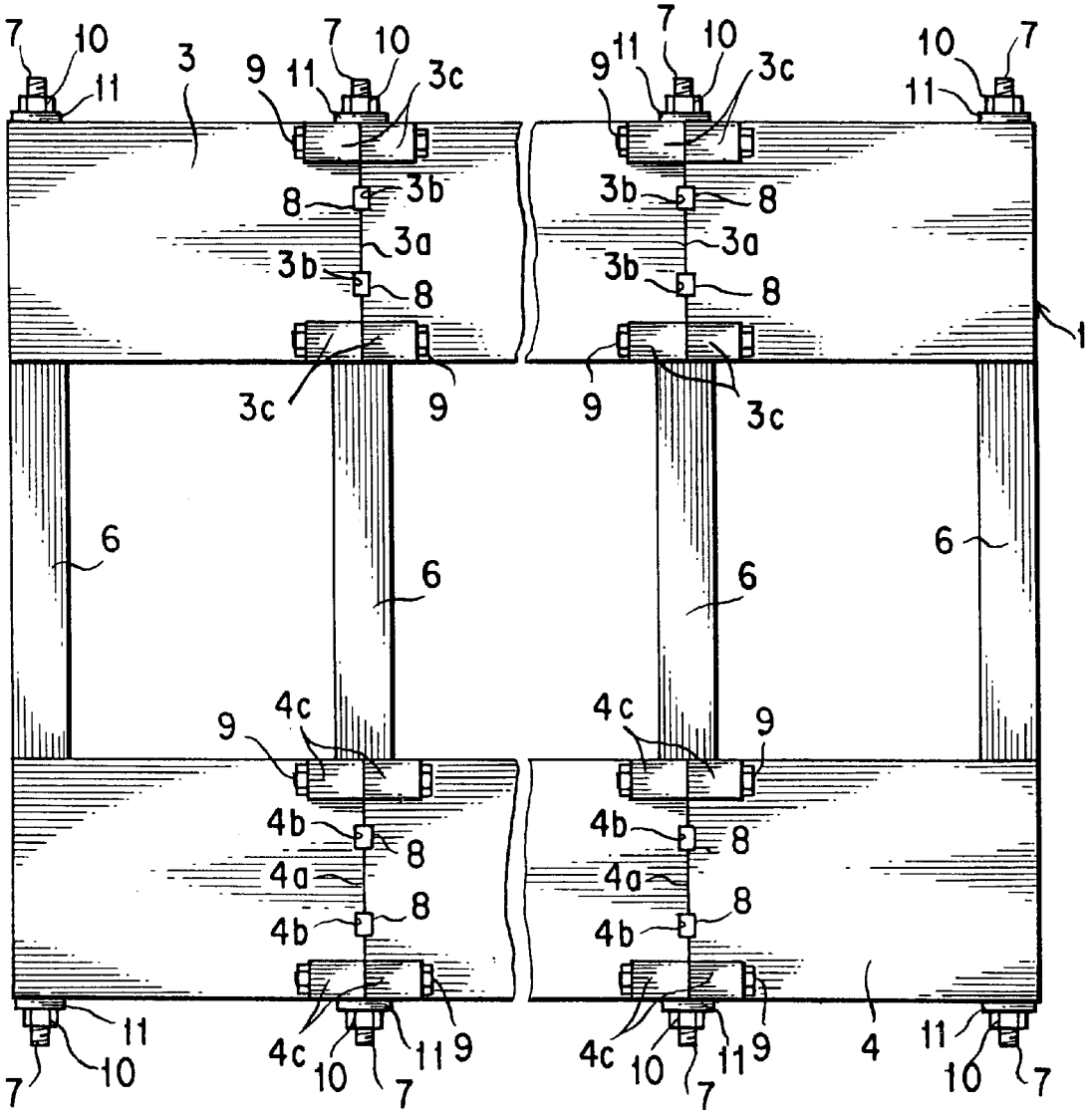
FIG. 6 is a structural view showing an assembling state of a crown and a bed of a fourth embodiment of the present invention.

Although, in the above embodiments, the crown 3 and the bed 4 are both divided at portions offset from the central axis of the tie rod 7, the present invention is not limited to such embodiments and may involve the following alternative features, as such that the bed 4 is divided at portions near the central axes of the tie rods 7 as in the third embodiment shown in FIG. 5, and both the crown 3 and the bed 4 are divided at portions near the central axes of the tie rods 7, as in the fourth embodiment shown in FIG. 6.

Further, in the embodiment in which the crown 3 and/or the bed 4 are divided at portions near the central axes of the tie rods 7, there may be cases where stepped portions are formed at the upper surfaces of the adjacent crown sections 3 and the bottom surfaces of the adjacent bed sections 4 by errors in manufacturing the crown sections 3, the bed sections 4 and the uprights 6.

In such cases, the crown sections 3 and the bed sections 4 may be fastened by means of the tie rods 7 after the stepped portions have been removed by grinding the fastening portions of the upper surfaces of the crown sections 3 and the fastening portions of the bottom surfaces of the bed sections 4 by means of a grinder, or by interposing shims or the like. In this manner, the fastening force is uniformly applied to the adjacent crown sections 3 and bed sections 4, ensuring the fastening operation, and moreover, an undesired stress is not applied to the horizontal fastening means 9 for fastening the adjacent crown section 3 and bed section 4 in the horizontal direction, and a suitable fastening force can be maintained, thus being convenient.

Further, it is to be noted that the respective embodiments mentioned above are related to the module type transfer press in which the crown 3 and the bed 4 are divided into a plurality of sections for the various working stations W1, W2, - - - , and the respective crown sections 3 and bed sections 4 are made into units in combination with the slides 5, but the present invention may of course be applicable to a transfer press of a general structure. Further, it may be possible to arrange a plurality of tie rods 7 side by side in a direction normal to the work conveying direction with respect to one upright.

Further, it is self-evident to a person skilled in the art that although the present invention is described hereinbefore with reference to the exemplary embodiments, it is possible to make various changes, deletions and additions to the disclosed embodiments without departing from the subject and scope of the present invention. Accordingly, it is to be understood that the present invention is not limited to the described embodiments and includes the scopes and equivalents defined by the elements recited in the appended claims.

I claim:

1. A transfer press in which a crown is mounted on a plurality of uprights disposed vertically in a bed, the crown and the bed are fastened by tie rods penetrating through the respective uprights to thereby constitute a press body, a plurality of working stations are set in the press body, the crown and the bed are divided for every working station, and a slide is assembled with each divided crown section and each divided bed section so as to form a module unit, wherein the tie rods are disposed along a work conveying direction with respect to the respective uprights, said crown and said bed are divided into a plurality of crown sections and bed sections at portions slightly offset from central axes of the tie rods, positioning keys are fitted into key grooves formed in respective divided surfaces of the crown sections and bed sections, and adjacent crown sections and adjacent bed sections are coupled by horizontal connection means.

2. A transfer press in which a crown is mounted on a plurality of uprights disposed vertically in a bed, the crown and the bed are fastened by tie rods penetrating through the respective uprights to thereby constitute a press body, a plurality of working stations are set in the press body, the crown and the bed are divided for every working station, and a slide is assembled with each divided crown section and each divided bed section so as to form a module unit, wherein the tie rods are disposed along a work conveying direction with respect to the respective uprights, one of said crown and said bed is divided into a plurality of crown sections or bed sections at portions slightly offset from central axes of the tie rods, another one of said crown and said bed is divided into a plurality of crown sections or bed sections at portions near the central axes of the tie rods, positioning keys are fitted into key grooves formed in respective divided surfaces of the crown sections and bed sections, and adjacent crown sections and adjacent bed sections are coupled by horizontal connection means.

3. A transfer press in which a crown is mounted on a plurality of uprights disposed vertically in a bed, the crown and the bed are fastened by tie rods penetrating through the respective uprights to thereby constitute a press body, a plurality of working stations are set in the press body, the crown and the bed are divided for every working station, and a slide is assembled with each divided crown section and each divided bed section so as to form a module unit, wherein the tie rods are disposed along a work conveying direction with respect to the respective uprights, said crown and said bed are divided into a plurality of crown sections and bed sections at portions near central axes of the tie rods, positioning keys are fitted into key grooves formed in respective divided surfaces of the crown sections and bed sections, and adjacent crown sections and adjacent bed sections are coupled by horizontal connection means.

* * * * *